US007604482B2

(12) United States Patent
Shen et al.

(10) Patent No.: US 7,604,482 B2
(45) Date of Patent: Oct. 20, 2009

(54) ELECTRICAL CONNECTOR WITH RETAINING DEVICE

(75) Inventors: Guo-Jian Shen, Kunshan (CN); Ren-Chih Li, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/077,563

(22) Filed: Mar. 20, 2008

(65) Prior Publication Data

US 2008/0233770 A1 Sep. 25, 2008

(30) Foreign Application Priority Data

Mar. 20, 2007 (CN) ..... 2007 1 0020716

(51) Int. Cl.
*H01R 12/00* (2006.01)

(52) U.S. Cl. ..... 439/64; 439/607.01

(58) Field of Classification Search ..... 439/64, 439/359, 564, 565, 563, 569, 570, 573, 607, 439/607.01

See application file for complete search history.

(56) References Cited

U.S. PATENT DOCUMENTS

| | | | | |
|---|---|---|---|---|
| 5,178,557 | A * | 1/1993 | Hashiguchi | 439/357 |
| 5,947,769 | A | 9/1999 | Leonard et al. | |
| 6,579,123 | B2 | 6/2003 | Kasahara | |
| 6,736,676 | B2 * | 5/2004 | Zhang et al. | 439/607 |

* cited by examiner

*Primary Examiner*—Tho D Ta
*Assistant Examiner*—Travis Chambers
(74) *Attorney, Agent, or Firm*—Andrew C. Cheng; Wei Te Chung; Ming Chieh Chang

(57) ABSTRACT

An electrical connector includes an insulating housing (1) mounting a plurality of terminals (2), a metallic shell (3) surrounding the housing and a pair of retaining devices (4). The shell (3) comprises a pair of opposite sidewalls (31, 32) and a pair of endwalls (33) interconnecting with the side walls, thereby defining a receiving space surrounding the housing. Each endwall (33) defines a pair of locking portions (34,35) respectively on opposite sides and a holding portion (36) on a rear portion. Each retaining device (4) comprises a main body (41) with a nut (40) therein and an extending board (42) extending rearwards from the main body. The locking portions (34, 35) are retained in corresponding channels (411) defined on the retaining devices (3) and the holding portion (36) presses against a rear portion of the extending board (42).

8 Claims, 4 Drawing Sheets

ELECTRICAL CONNECTOR WITH RETAINING DEVICE

BACKGROUND OF THE INVENTION

1. Field of the Invention

The present invention relates to an electrical connector, and particularly to an electrical connector including a retaining device.

2. Description of the Prior Art

Electrical connectors are often used in electronic devices for transmitting signals or establishing electrical connection between electronic devices and other systems. Usually, the electrical connectors are mounted onto the electronic devices by a retaining device, such as U.S. Pat. No. 6,579,123 which discloses an insulating housing 4 with two protrusion portions 5 extending from opposite endwalls of the housing 4 and a retaining device 13. The retaining device 13 is mounted to the protruding portion 5 and a screw member 1 is provided for fixing the retaining device 13 to a board 2.

With the rapid development of the electronic devices, the electrical connectors are more and more powerful to fulfill the function of the electronic device, therefore more and more terminals are fixed in the housing and a metallic shell is provided surrounding the housing. A new design which is adapted for the new development is required.

SUMMARY OF THE INVENTION

Accordingly, an object of the present invention is to provide an electrical connector with a retaining device mounted on a metallic shell.

In order to achieve the object set forth, an electrical connector comprises: an insulating housing mounting a plurality of terminals thereon; a metallic shell comprising a pair of opposite sidewalls and a pair of endwalls interconnecting with the side walls, thereby defining a receiving space surrounding the housing, each endwall defining a pair of locking portions respectively on opposite sides thereof and a holding portion on a rear portion thereof, and a pair of retaining devices, each comprising a main body with a nut therein and an extending board extending rearwards from the main body thereof, the locking portions are retained in corresponding channels defined on the retaining devices and the holding portion presses against a rear portion of the extending board.

Other objects, advantages and novel features of the invention will become more apparent from the following detailed description of the present embodiment when taken in conjunction with the accompanying drawings.

DETAILED DESCRIPTION OF THE INVENTION

Figure 1:
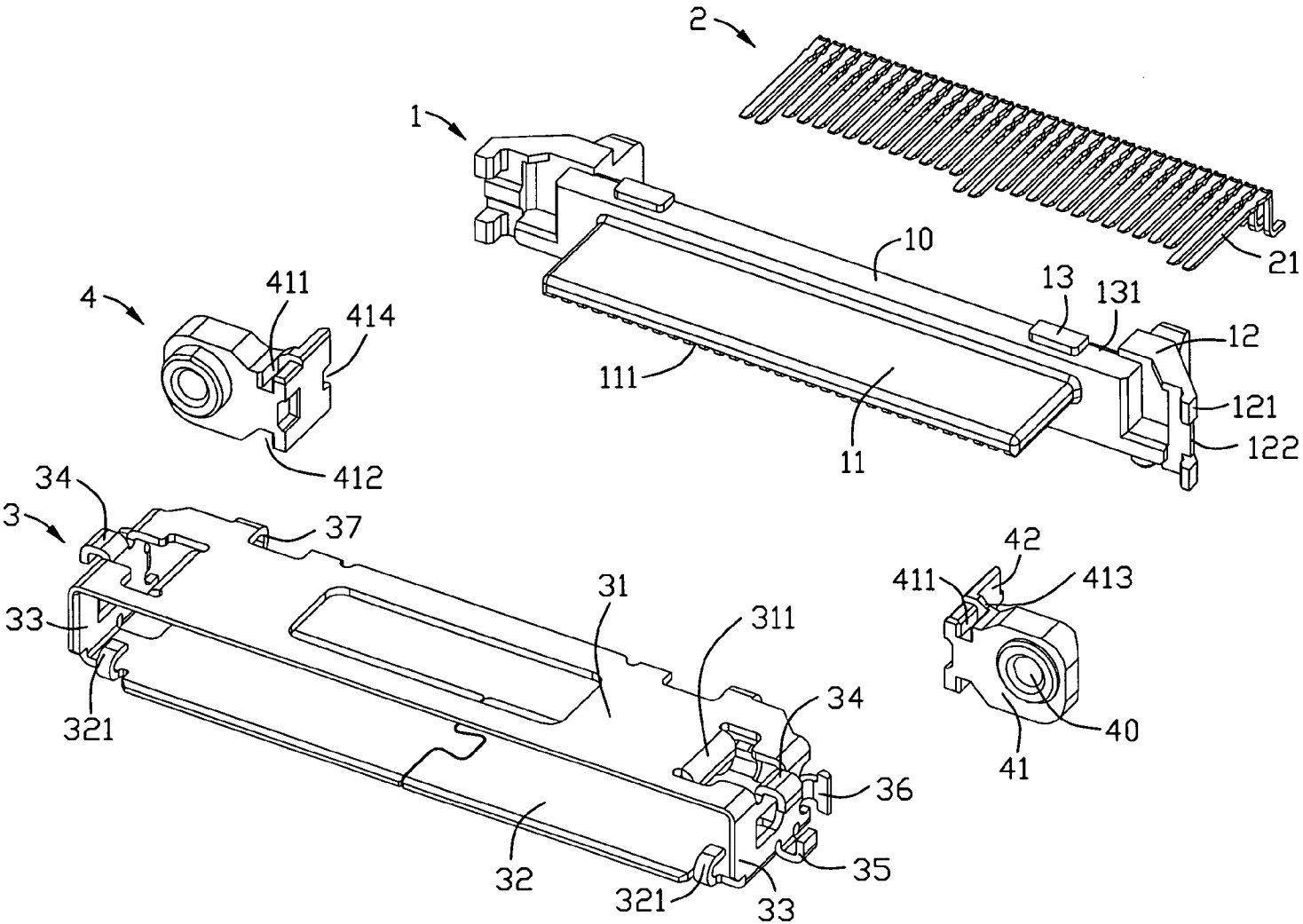
FIG. 1 is an exploded perspective view of an electrical connector in accordance with the present invention.

Reference will now be made to the drawing figures to describe a preferred embodiment of the present invention in detail.

Referring to FIG. 1, an electrical connector according to the present invention is provided and comprises an insulating housing 1 with a plurality of conductive terminals 2 mounted therein, a metallic shell 3 surrounding the housing 1 and a pair of retaining devices 4 mounted at both lateral ends of the metallic shell 3.

The insulating housing 1 comprises an elongated main body 10. A plate like tongue portion 11 extends forward from a front face of the main body 10 and defines a plurality of terminal grooves 111 in a lower surface thereof. The terminal grooves 111 are set in a predetermined interval and running through the main body 10 along a front-to-back direction. A pair of protrusion portions 12 are extending outwardly from opposite ends of the main body 10 along a longitudinal direction and a pair of front-protruding tabs 121 extending forward from one lateral ends of protrusion portions 12 and a notch 122 is defined between the two tabs 121. A pair of blocking portions 13 are respectively formed on an upper surface of the main body 10, abutting the protrusion portions 12 and a passageway 131 is defined between the block 13 and the protrusion portion 12. The conductive terminals 2 are inserted into the terminal grooves 111 until contact portions 21 are received in the tongue portion 11.

Referring to FIG. 1, the metallic shell 3 is made by stamping a metal sheet. The shell 3 comprises a flat upper wall 31, a lower wall 32 opposite and parallel to the upper wall 31 and two opposite endwalls 33 interconnecting the upper wall 31 and lower wall 32, thereby defining a receiving space encapsulating the housing 1. A pair of tabs 311 are respectively formed by bending a cutout portion (not figured) downwardly from the upper wall 31 and in parallel to the endwalls 33. A pair of anti-disorientation arrangements 321 are arranged on opposite ends of a front edge of the lower wall 321 and bent into the receiving space in parallel to the upper wall 31. The tab 311 and the anti-disorientation arrangement 321 can prevent a mating connector (not shown) from mispluging. See FIG. 2, a pair of bending portions 37 are respectively formed at opposite ends of a rear edge of the upper wall 31 and lower wall 32 and extend rearwardly.

A pair of first locking portions 34 are respective formed at opposite ends of the upper wall 31. The first locking portions 34 extend outwardly and then downwardly from the upper wall. A pair of second locking portions 35 are respectively formed at opposite ends of the lower wall 32. The second locking portions 35 extend outwardly and then upwardly. The first locking portions 34 are offset from the second locking portions 35 and the first locking portions 34 are nearer to a front edge of the endwalls 33. A pair of holding portions 36 are respectively formed in the rear end of the endwalls 33.

The retaining device 4 comprises a main body 41 embedded with a nut 40 in a middle portion thereof. A channel 411 is defined at an upper portion of a lateral end of the main body 41 and leaves a stopping portion 413 in a rear end. An extending board 42 extends rearwardly perpendicular to the main body 41 and defines a receiving hole 414 in a rear end. More, a projecting portion 412 is formed on the extending board 42, as shown in FIG. 3.

Figure 2:
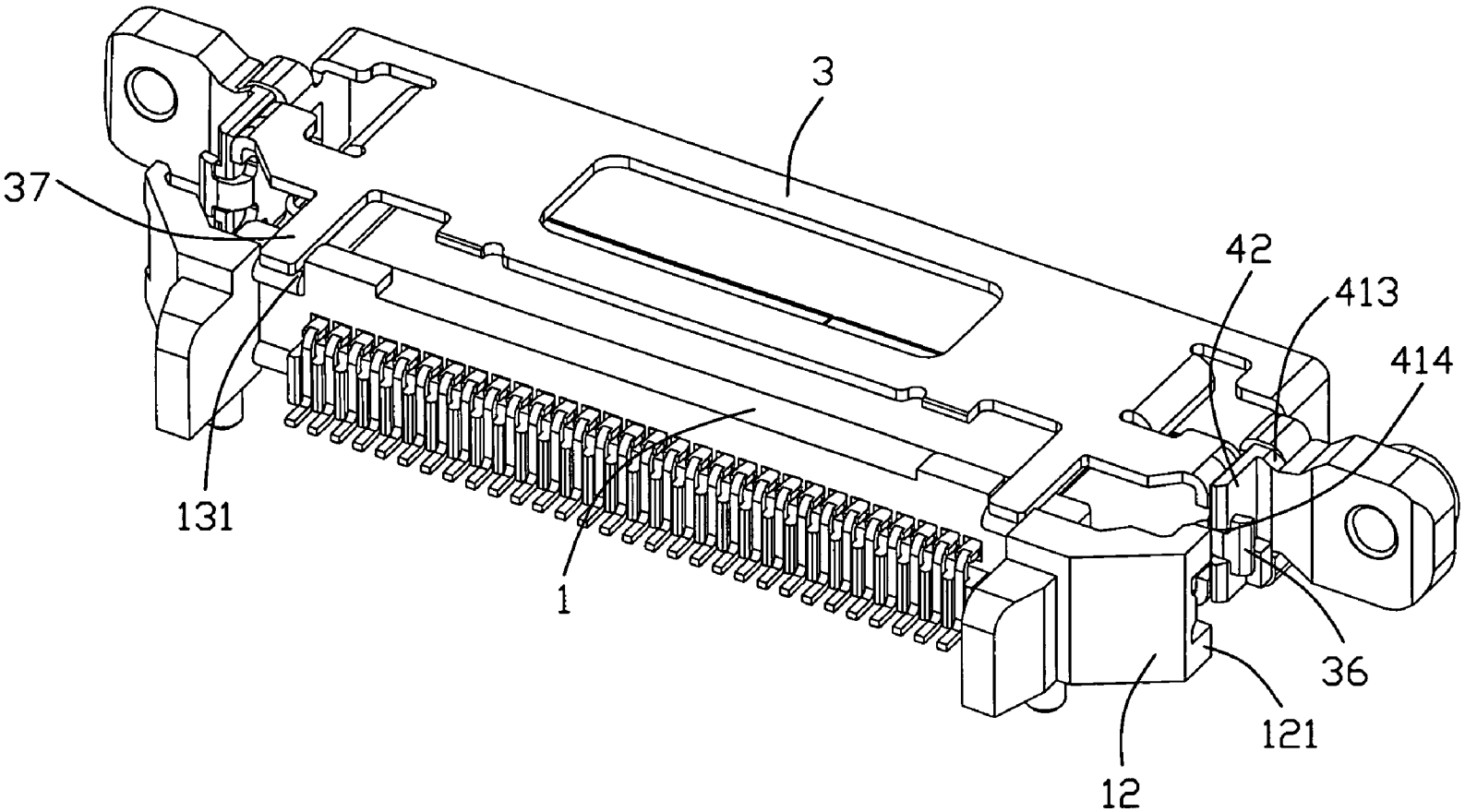
FIG. 2 is a perspective view of the electrical connector when the insulating housing is not inserted into a shell of the electrical connector.
Figure 4:
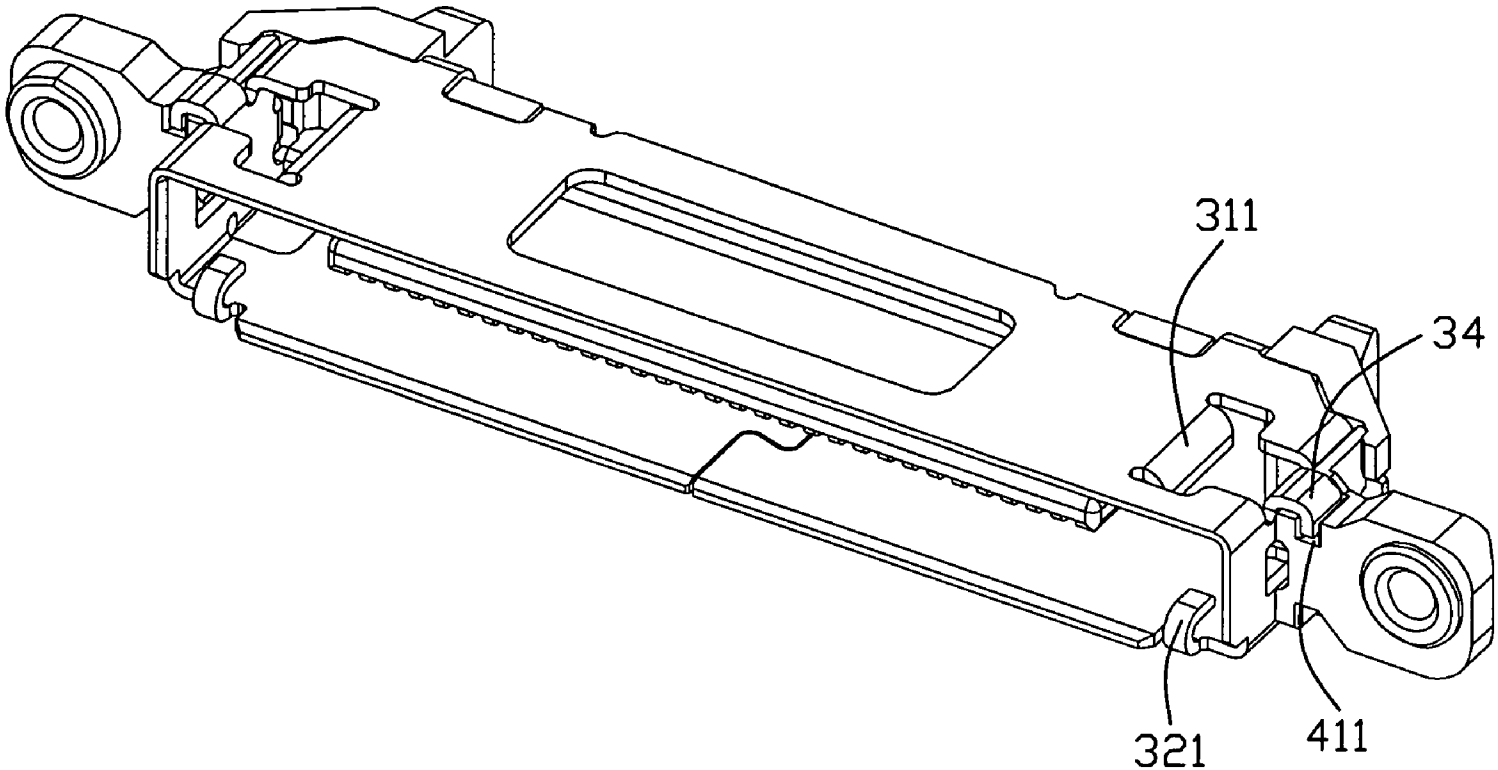
FIG. 4 is another perspective view of the electrical connector shown in FIG. 3.

Referring to FIG. 2, the retaining device 4 is firstly mounted on the endwall 33 of the metallic shell 3 in a rear-to-front direction and the first locking portions 34 is inserted into the channels 411 until the locking portion 34 abuts against the stopping portions 413 behind the channel 411. The second locking portion 35 is pressing on the projecting portion 412. The locking portions 34, 35 can restrain the retaining device 4 therebetween and the stopping portion 413 can prevent the retaining device from forward moving, see FIG. 4. Then, the holding portion 36 is bent to press against the extending board 42, thereby the retaining device 4 can not move rearward. So, the retaining device 4 is fixedly mounted on one end of the shell 3 without any difficulty.

Figure 3:
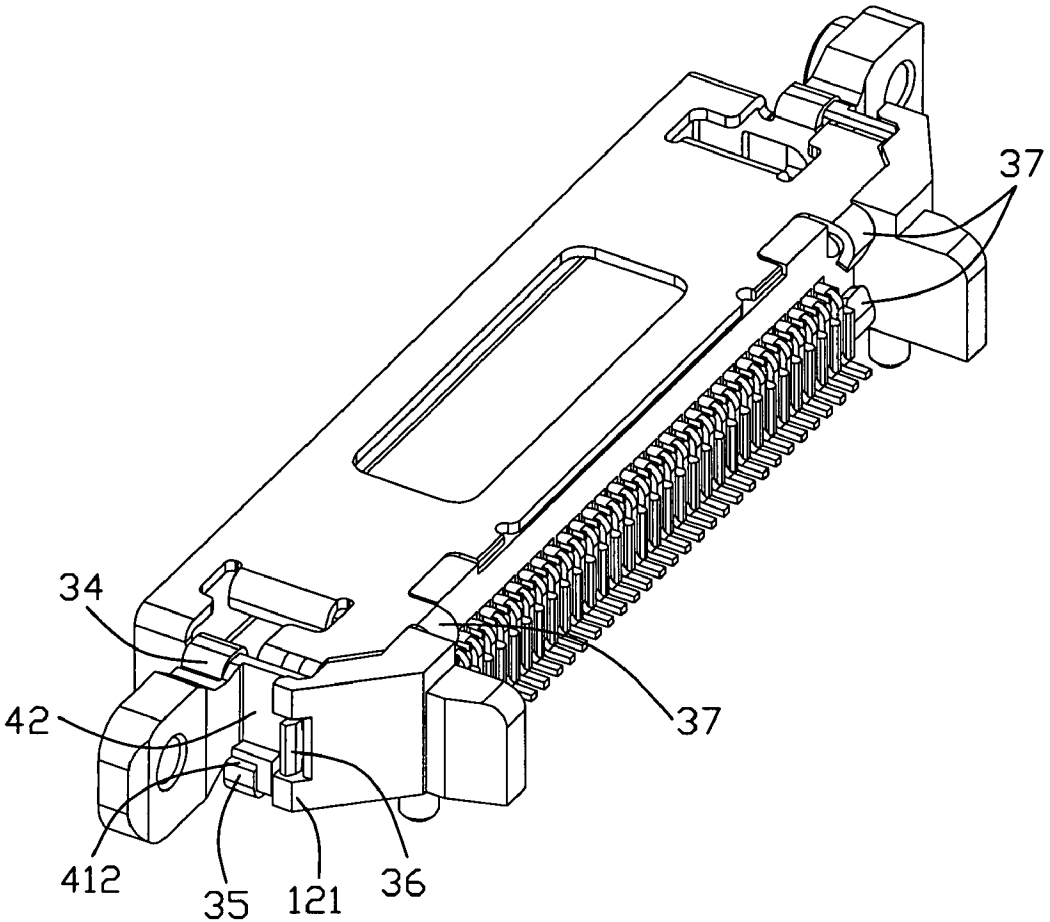
FIG. 3 is an assembled perspective view of the electrical connector shown in FIG. 1.

Referring to FIGS. 2 and 3, the insulating housing 1 is mounted in the metallic shell 3 from the rear end of the shell. The tongue portion 11 is inserted into the receiving space of the shell until the main body 10 is relying on the rear end of the shell, and the protrusion portions 12 are engaging with the endwalls 31 of the shell. The bending portions 37 are inserted into the passageways 131 and then bent downwardly to hold the insulating housing in the shell. Meanwhile, the front-protruding tabs 121 press against the extending board 42 of the retaining device 4 with holding portion 36 against the aperture 122, which can further retain the retaining device on the shell, see FIG. 3.

In this embodiment, the retaining device 4 is mounted on the shell 3 by being buckled with the locking portions on the endwall 33 of the shell, and the extending board 42 of the retaining device 4 is received in a receiving room defined by the locking portions 34, 35, endwall 33 and holding portion 36. Further, the front-protruding tabs 121 can strength the retaining effect of the retaining device 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing mounting a plurality of terminals thereon;

a metallic shell comprising a pair of opposite sidewalls and a pair of endwalls interconnecting with the side walls, thereby defining a receiving space surrounding the housing, each endwall defining a pair of locking portions respectively at opposite sides thereof and a holding portion on a rear portion thereof;

a pair of retaining devices, each comprising a main body with a nut therein and an extending board extending rearwards from the main body thereof, and wherein the main body of each retaining device defines a channel therein and leaves a stopping portion in a rear end, the corresponding locking portion being inserted into the channel and abutting against the stopping portion, and the holding portion pressing against a rear portion of the extending board.

2. The electrical connector as described in claim 1, wherein the insulating housing comprises a main body and a pair of protrusion portions extend outwardly from opposite ends of the main body along a longitudinal direction, a pair of front-protruding tabs extending forward from lateral ends of each protrusion portion to suppress the extending board of each retaining device.

3. The electrical connector as described in claim 2, wherein the holding portion of the shell is received in an aperture defined between the pair of front-protruding tabs when the insulating housing is mounted in the shell.

4. An electrical connector comprising:

an insulative housing defining an elongated main body with two opposite retaining sections at two longitudinal ends, and with a mating tongue extending forwardly from a middle portion of the main body;

a metallic shell defining opposite upper and bottom faces and opposite two end faces commonly defining a space receiving said mating tongue;

a pair of mounting ears discrete from said housing and said shell and assembled to the shell, said shell defining first and second gripping sections respectively grasping the main body and the corresponding mounting ear; wherein said retaining section blocks rearward movement of the corresponding mounting ear therein said shell further includes an abutment section blocking backward movement of the corresponding mounting ear and sandwiched between the corresponding mounting ear and the corresponding retaining section in a front-to-back direction.

5. The electrical connector as claimed in claim 4, wherein said second gripping section defines a channel only allowing forward assembling of the mounting ear with regard to the shell, and the abutment section is bent to a final position only after the mounting ear has been filly assemble to the shell.

6. The electrical connector as claimed in claim 4, wherein said retaining section has one portion directly engaging the corresponding mounting ear and another portion directly engaging the corresponding abutment section of the shell.

7. An electrical connector comprising:

an insulative housing having a base portion and a mating tongue extending from the base portion, a plurality of contacts extending from the base portion to the mating tongue;

a metallic shell attached to the base portion and substantially enclosing the mating tongue for receiving a mating connector therein, the metallic shell having transversal end walls and each including first and second locking tabs extending face-to-face from opposite edges thereof and offset from each other, and jointly defining a retaining space therein;

a pair of retaining devices discrete from said insulating housing and said metallic shell and assembled to said metallic shell, each of said pair of retaining devices including an extending board securely retained in the retaining space and a main body projecting out of the retaining space; and a third locking tab extending from the end wall to prevent the extending board from escaping from the retaining space.

8. The electrical connector as described in claim 7, wherein a pair of retaining sections are respectively formed at two longitudinal ends for further blocking the rearward movement of the retaining devices.

* * * * *